US008695322B2

(12) United States Patent
Davis, Jr. et al.

(10) Patent No.: US 8,695,322 B2
(45) Date of Patent: Apr. 15, 2014

(54) THERMALLY DECOUPLED CAN-ANNULAR TRANSITION PIECE

(75) Inventors: Lewis Berkley Davis, Jr., Niskayuna, NY (US); Ronald James Chila, Greer, SC (US)

(73) Assignee: General Electric Company, Schenectady, NY (US)

( * ) Notice: Subject to any disclaimer, the term of this patent is extended or adjusted under 35 U.S.C. 154(b) by 989 days.

(21) Appl. No.: 12/413,991

(22) Filed: Mar. 30, 2009

(65) Prior Publication Data

US 2010/0242487 A1 Sep. 30, 2010

(51) Int. Cl.
*F01D 9/02* (2006.01)
*F23R 3/06* (2006.01)

(52) U.S. Cl.
USPC ..... 60/39.37; 60/754; 60/755; 60/752

(58) Field of Classification Search
USPC ..... 60/752, 755, 758, 760, 754, 782, 39.37
See application file for complete search history.

(56) References Cited

U.S. PATENT DOCUMENTS

| | | | | |
|---|---|---|---|---|
| 3,652,181 | A * | 3/1972 | Wilhelm, Jr. | 60/748 |
| 4,719,748 | A * | 1/1988 | Davis et al. | 60/39.37 |
| 5,509,270 | A | 4/1996 | Pearce et al. | |
| 5,682,747 | A | 11/1997 | Brown et al. | |
| 5,758,503 | A | 6/1998 | DuBell et al. | |
| 5,758,504 | A * | 6/1998 | Abreu et al. | 60/754 |
| 5,894,732 | A | 4/1999 | Kwan | |
| 5,974,805 | A | 11/1999 | Allen | |
| 6,408,628 | B1 | 6/2002 | Pidcock et al. | |
| 6,546,627 | B1 * | 4/2003 | Sekihara et al. | 60/752 |
| 6,571,560 | B2 * | 6/2003 | Tatsumi et al. | 60/753 |
| 6,606,861 | B2 | 8/2003 | Snyder | |
| 6,640,547 | B2 * | 11/2003 | Leahy, Jr. | 60/752 |
| 6,675,586 | B2 | 1/2004 | Maghon | |
| 6,701,714 | B2 | 3/2004 | Burd et al. | |
| 6,792,757 | B2 | 9/2004 | Borns et al. | |

(Continued)

FOREIGN PATENT DOCUMENTS

| | | | |
|---|---|---|---|
| CN | 86105250 | A | 2/1988 |
| CN | 88101760 | A | 10/1988 |
| EP | 1426558 | A2 | 6/2004 |
| JP | 2003286863 | A | 10/2003 |

OTHER PUBLICATIONS

Chinese Office Action for CN Application No. 201010156194.6, dated Sep. 26, 2013, pp. 1-21.

(Continued)

*Primary Examiner* — Ted Kim
(74) *Attorney, Agent, or Firm* — Cantor Colburn LLP

(57) ABSTRACT

A turbomachine includes a plurality of injection nozzles arranged in a can-annular array and a transition piece including at least one wall that defines a combustion flow passage. A dilution orifice is formed in the at least one wall of the transition piece. The dilution orifice guides dilution gases to the combustion flow passage. A heat shield member is mounted to the at least one wall of the transition piece in the combustion flow passage. The heat shield member includes a body having a first surface and an opposing second surface through which extends a dilution passage. The dilution passage is off-set from the dilution orifice. The heat shield member is spaced from the at least one wall of the transition piece defining a flow region between the at least one wall and the second surface.

14 Claims, 5 Drawing Sheets

(56) References Cited

U.S. PATENT DOCUMENTS

| | | | | |
|---|---|---|---|---|
| 6,810,673 | B2 | 11/2004 | Snyder | |
| 6,938,424 | B2 * | 9/2005 | Tiemann | 60/752 |
| 7,093,439 | B2 | 8/2006 | Pacheco-Tougas et al. | |
| 7,270,175 | B2 | 9/2007 | Mayer et al. | |
| 7,363,763 | B2 | 4/2008 | Coughlan, III et al. | |
| 8,033,119 | B2 * | 10/2011 | Liang | 60/752 |
| 8,387,396 | B2 | 3/2013 | Chen et al. | |
| 2002/0056277 | A1 * | 5/2002 | Parry | 60/752 |
| 2005/0241321 | A1 | 11/2005 | Martling et al. | |
| 2007/0144177 | A1 | 6/2007 | Burd | |
| 2010/0229564 | A1 * | 9/2010 | Chila | 60/752 |

OTHER PUBLICATIONS

Japanese Office Action for JP Application No. 2010-071279, dated Jan. 8, 2014, pp. 1-6.

* cited by examiner

THERMALLY DECOUPLED CAN-ANNULAR TRANSITION PIECE

BACKGROUND OF THE INVENTION

The subject matter disclosed herein relates to the art of turbomachines and, more particularly, to a turbomachine including a thermally decoupled can-annular transition piece.

In general, gas turbine engines combust a fuel/air mixture that releases heat energy to form a high temperature gas stream. The high temperature gas stream is channeled to a turbine via a hot gas path. The turbine converts thermal energy from the high temperature gas stream to mechanical energy that rotates a turbine shaft. The turbine may be used in a variety of applications, such as for providing power to a pump or an electrical generator.

Many gas turbines include an annular combustor within which are formed the combustion gases that create the high temperature gas stream. Other turbomachines employ a plurality of combustors arranged in a can-annular array. In such a turbomachine, the combustion gases are formed in each of the plurality of combustors and delivered to the turbine through a transition piece. In addition to providing a passage to the turbine, the transition piece provides an additional opportunity to enhance combustion. Certain turbomachines employ a series of dilution passages arranged in the transition piece. A portion of compressor air is passed along the transition piece, through the dilution passages, and into the combustion airstream. This portion of the compressor air, or dilution gases, is employed to enhance a profile/pattern factor of the combustion gases.

BRIEF DESCRIPTION OF THE INVENTION

According to one aspect of the invention, a turbomachine includes a plurality of injection nozzles arranged in a can-annular array and a transition piece including at least one wall that defines a combustion flow passage. A dilution orifice is formed in the at least one wall of the transition piece. The dilution orifice guides dilution gases to the combustion flow passage. A heat shield member is mounted to the at least one wall of the transition piece in the combustion flow passage. The heat shield member includes a body having a first surface and an opposing second surface through which extends a dilution passage. The dilution passage is off-set from the dilution orifice. The heat shield member is spaced from the at least one wall of the transition piece defining a flow region between the at least one wall and the second surface.

According to another aspect of the invention, a method of thermally decoupling a transition piece from combustion gases in a turbomachine includes creating cooling gases in a compressor portion of the turbomachine, generating combustion gases in a plurality of combustion chambers arranged in a can-annular array, guiding the combustion gases into a flow cavity of the turbomachine. The flow cavity fluidly connects the can-annular array of combustion chambers with a first stage of a turbine. The method further includes shielding an internal surface of the transition piece from the combustion gases with at least one heat shield member. The at least one heat shield member is spaced from the internal surface of the transition piece to form a flow cavity. The cooling airflow is passed through at least one dilution orifice formed in the transition piece. The dilution orifice is fluidly connected to the flow cavity. Finally, the method includes guiding the cooling airflow through at least one dilution passage formed in the at least one heat shield member. The at least one dilution passage is off-set from the at least one dilution orifice so as create an effusion airflow that passes over a surface of the at least one heat shield member to thermally decouple the inner wall of the transition piece from the combustion gases.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
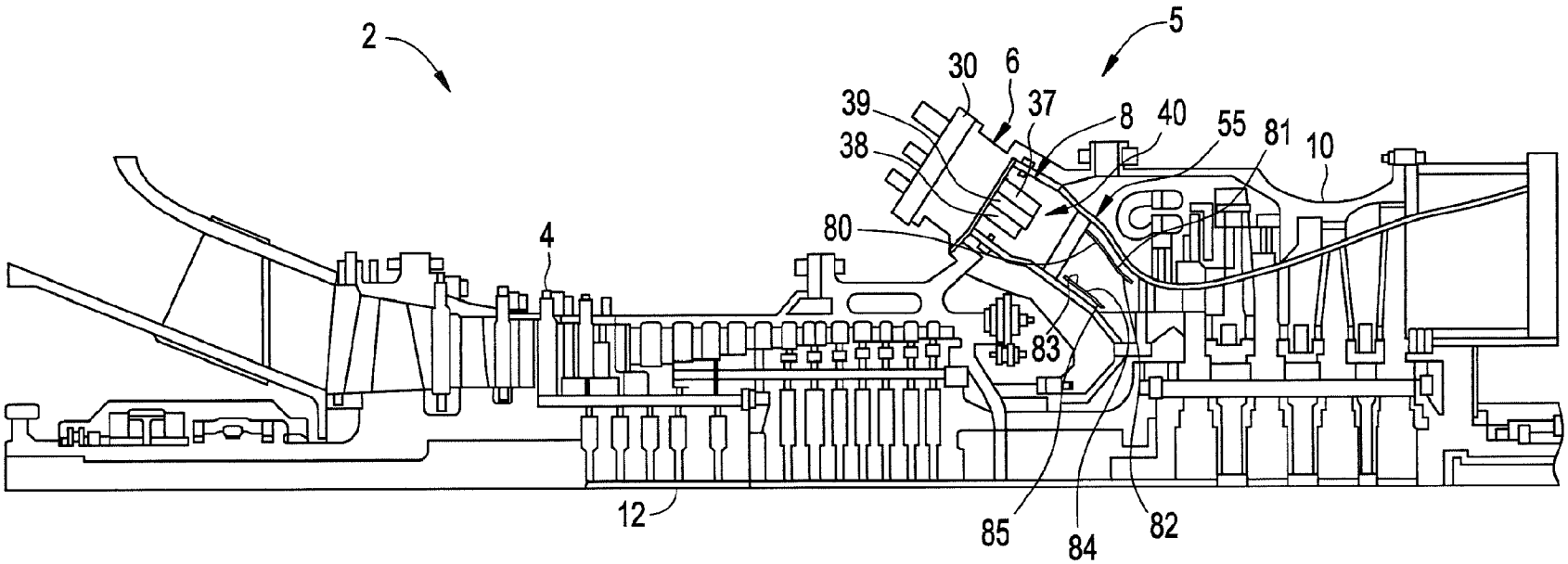
FIG. 1 is a partial cross-sectional view of a turbomachine including a thermally decoupled transition piece in accordance with an exemplary embodiment.

With reference to FIG. 1, a turbomachine constructed in accordance with an exemplary embodiment is indicated generally at 2. Turbomachine 2 includes a compressor 4 and a combustor assembly 5 having at least one combustor 6 provided with an injection nozzle assembly housing 8. Turbomachine 2 also includes a turbine 10 and a common compressor/turbine shaft 12. Notably, the present invention is not limited to any one particular engine and may be used in connection with other turbomachines.

Figure 2:
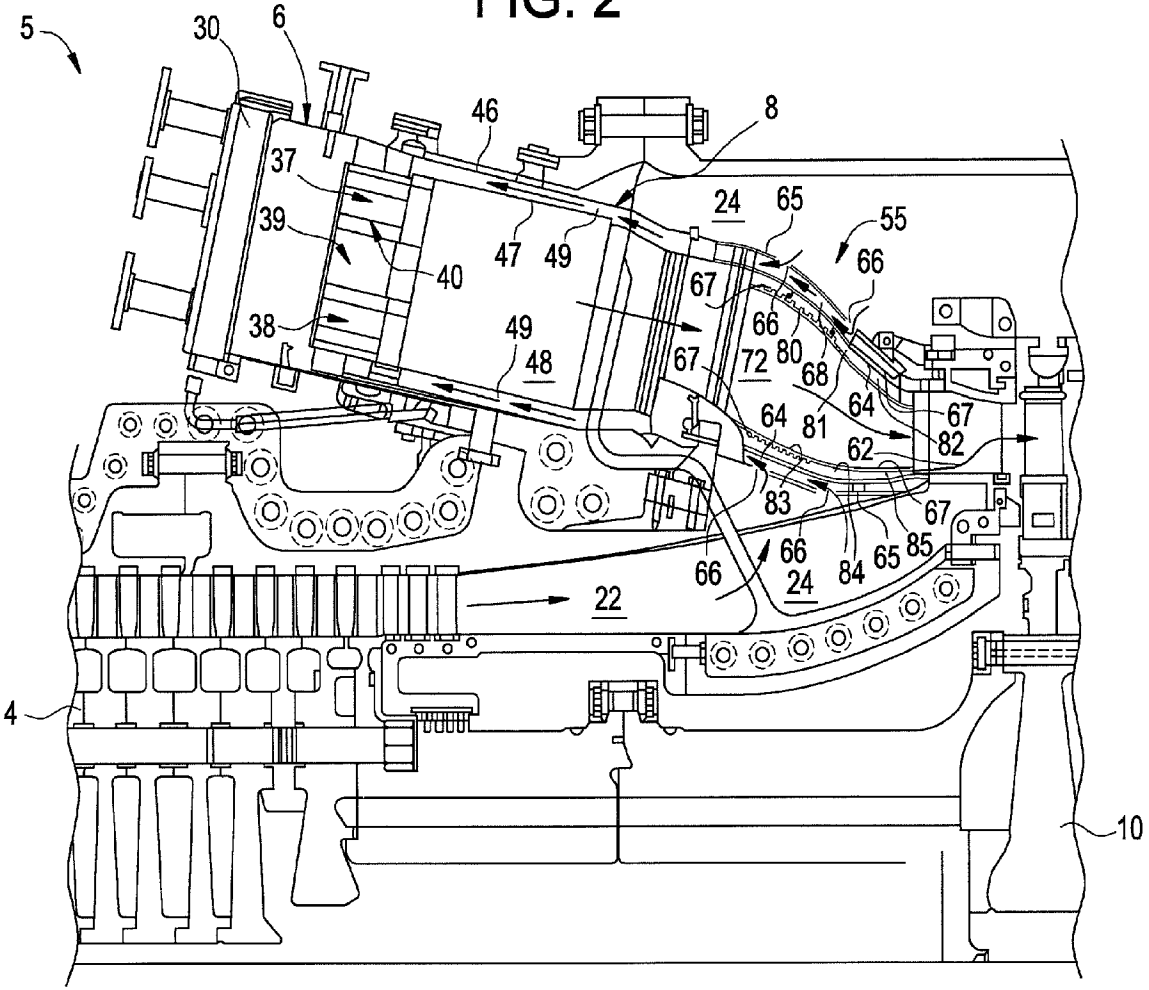
FIG. 2 is partial, cross-sectional view of a combustor portion of the turbomachine of FIG. 1.

As best shown in FIG. 2, combustor 6 is coupled in flow communication with compressor 4 and turbine 10. Compressor 4 includes a diffuser 22 and a compressor discharge plenum 24 that are coupled in flow communication with each other. Combustor 6 also includes an end cover 30 positioned at a first end thereof, and a cap member 34. Combustor 6 further includes a plurality of pre-mixers or injection nozzles, two of which are indicated at 37 and 38. Injection nozzles 37 and 38 are arranged about a central nozzle 39 forming a can-annular array 40. Although only three injection nozzles are shown, it should be understood that the number of injection nozzles employed in can annular array 40 can vary. In addition, combustor 6 includes a combustor casing 46 and a combustor liner 47. As shown, combustor liner 47 is positioned radially inward from combustor casing 46 so as to define a combustion chamber 48. An annular combustion chamber cooling passage 49 is defined between combustor casing 46 and combustor liner 47.

Combustor 6 is coupled to turbomachine 2 through a transition piece 55. Transition piece 55 channels combustion gases from combustion chamber 48 downstream towards a first stage turbine nozzle 62. Towards that end, transition piece 55 includes an inner wall 64 and an outer wall or impingement sleeve 65. Outer wall 65 includes a plurality of openings 66 that lead to an annular flow passage 68 defined between inner wall 64 and outer wall 65. With this arrangement, outer wall 65 controls cooling air flow (and heat exchange) via a pressure differential within annular flow passage 68. Similarly, inner wall 64 includes a plurality of dilution orifices 67 that lead from annular flow passage 68 into a combustion flow passage 72 that extends between combustion chamber 48 and turbine 10. Flow passage 72 includes a compound curvature that is constructed to deliver the combustion gases to first turbine stage 62 in a manner that will be described more fully below.

During operation, air flows through compressor 4, is compressed, and passed to combustor 6 and, more specifically, to injection nozzles 37-39. At the same time, fuel is passed to injection nozzles 37-39 to mix with the compressed air to form a combustible mixture that passes from can-annular array 40 to combustion chamber 48 and ignited to form combustion gases. The combustion gases are then channeled to turbine 10 via transition piece 55. Thermal energy from the combustion gases is converted to mechanical rotational energy that is employed to drive compressor/turbine shaft 12.

More specifically, turbine 10 drives compressor 4 via compressor/turbine shaft 12 (shown in FIG. 1). As compressor 4 rotates, compressed air is discharged into diffuser 22 as indicated by associated arrows. In the exemplary embodiment, a majority of the compressed air discharged from compressor 4 is channeled through compressor discharge plenum 24 towards combustor 6. Any remaining compressed air is channeled for use in cooling engine components. Compressed air within discharge plenum 24 is channeled into transition piece 55 via outer wall openings 66 and into annular flow passage 68. In configurations that do not employ an annular flow passage, the compressor discharge air passes through openings 66 without the pressure differential created by outer wall 65. However, in the exemplary embodiment shown, a first or dilution portion of the compressed air is channeled from annular flow passage 68 through dilution orifices 67 into flow passage 72. A second portion of the compressed air is channeled through annular combustion chamber cooling passage 49 and to injection nozzles 37-39. The fuel and air are mixed to form the combustible mixture. The combustible mixture is ignited to form combustion gases within combustion chamber 48. Combustor casing 47 facilitates shielding combustion chamber 48 and its associated combustion processes from the outside environment such as, for example, surrounding turbine components. The combustion gases are channeled from combustion chamber 48 through guide cavity 72 and towards turbine nozzle 62. The hot gases impacting first stage turbine nozzle 62 create a rotational force that ultimately produces work from turbomachine 2. At this point it should be understood that the above-described construction is presented for a more complete understanding of exemplary embodiments. In addition, it should be understood that while the above described exemplary embodiment employs an impingement sleeve, other exemplary embodiments can be utilized both with and without the impingement sleeve.

Figure 3:
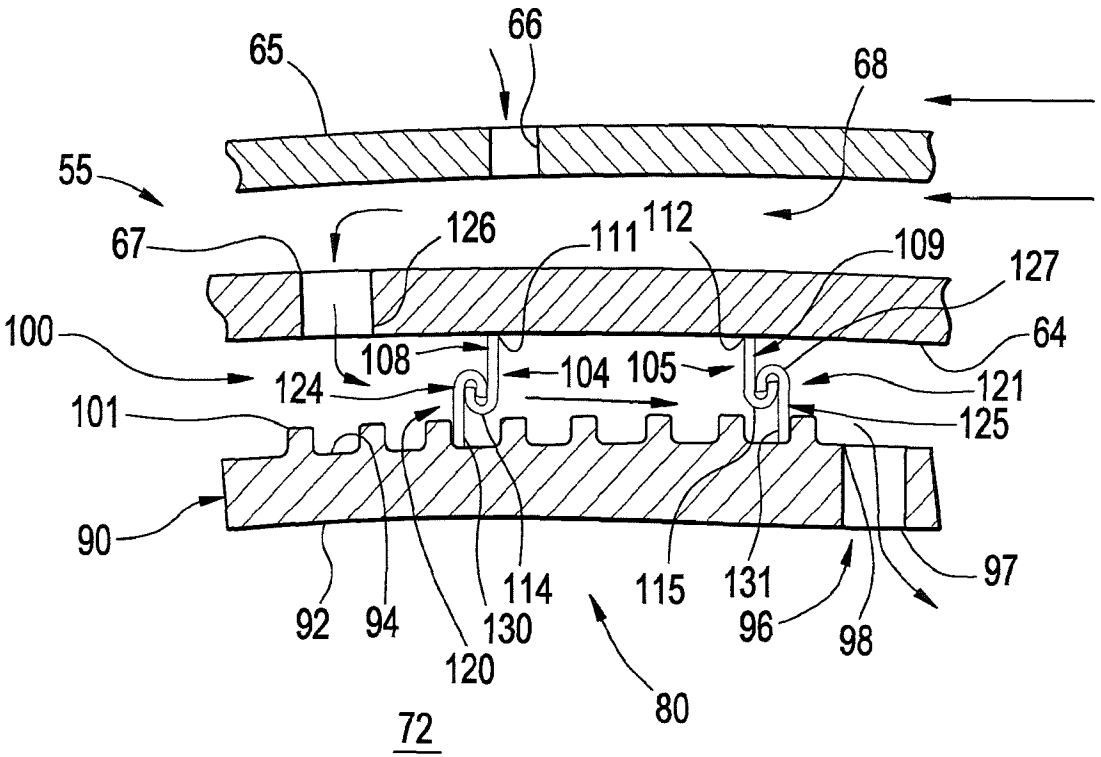
FIG. 3 is a detail view of a heat shield member in accordance with a first aspect of the exemplary embodiment.

In order to protect inner wall 64 from the effects of the hot combustion gases, transition piece 55 includes a plurality of heat shield members 80-85. As each heat shield member 80-85 includes similar structure, a detailed description will follow with reference to FIG. 3 in describing heat shield member 80 constructed in accordance with a first exemplary embodiment, with an understanding that heat shield members 81-85 are substantially similarly formed. As shown, heat shield member 80 includes a body 90 having a first surface 92 that extends to a second, opposing surface 94 through which extends a dilution passage 96. Body 90 is formed from, for example alloys of nickel or ceramics and shaped to conform to the compound curvature of transition piece 55. In addition, body 90 may include a thermal barrier coating applied to first surface 92 and/or second surface 94. Dilution passage 96 includes a first end section 97 that extends to a second end section 98. In accordance with the exemplary embodiment shown, dilution passage 96 is off-set from dilution orifice 67 in order to encourage flow along second surface 94. In addition, heat shield member 80 is spaced from inner wall 64 of transition piece 55 so as to define a flow region 100. The particular dimensions of flow region 100 can vary depending upon design requirements. In further accordance with the exemplary embodiment shown, heat shield member 80 includes a plurality of surface enhancements or protuberances, one of which is indicated at 101, that extend outward from second surface 94. Protuberances 101 create turbulence within the dilution air passing through flow region 100.

As stated above, heat shield member 80 is mounted to yet spaced from inner wall 64 of transition piece 55. Towards that end, transition piece 55 includes a plurality of mounting members, two of which are indicated at 104 and 105 that project outward from inner wall 64. In the exemplary embodiment shown, mounting members 104 and 105 take the form of hook members 108 and 109. Each hook member 108, 109 includes a corresponding first end section 111 and 112 as well, that extend to a second end section 114 and 115. Correspondingly, heat shield member 80 includes a plurality of mounting elements, two of which are indicated at 120 and 121, that project outward from second surface 94.

In the exemplary embodiment shown, mounting elements 120 and 121 take the form of hook elements 124 and 125. Each hook element 124, 125 includes a corresponding first end 126 and 127 that extends to a respective second end 130 and 131 prior to terminating in a hook (not separately labeled). Hook elements 124 and 125 engage with hook members 108 and 109 to mount heat sealed member 80 to transition piece 55 so as to define flow passage 100. With this arrangement, cooling air flowing through combustor flow passage 72 passes through dilution orifice 67 into flow region 100 to form dilution air. The dilution air passes along flow region 100 and through dilution passage 96 into combustor flow passage 72. Accordingly, heat shield member provides a thermal barrier to inner wall 64 of transition piece 55. The thermal barrier affords a level of protection to various portions of inner wall 64. For example, by decoupling inner wall 64 from the combustion gases in flow passage 72, cracking of inner wall 64, particularly in areas around dilution orifices 67, is mitigated. More specifically, hot gases ingested into a vena contracta formed with the dilution air mixes with the combustion gases leads to cracking of the inner wall 64 in areas adjacent dilution orifices 67. By providing an off set between dilution orifice 67 and dilution passage 96 ingestion of the hot gases is eliminated such that heat shield member 80 prolongs an overall operation lie of transition piece 55.

Figure 4:
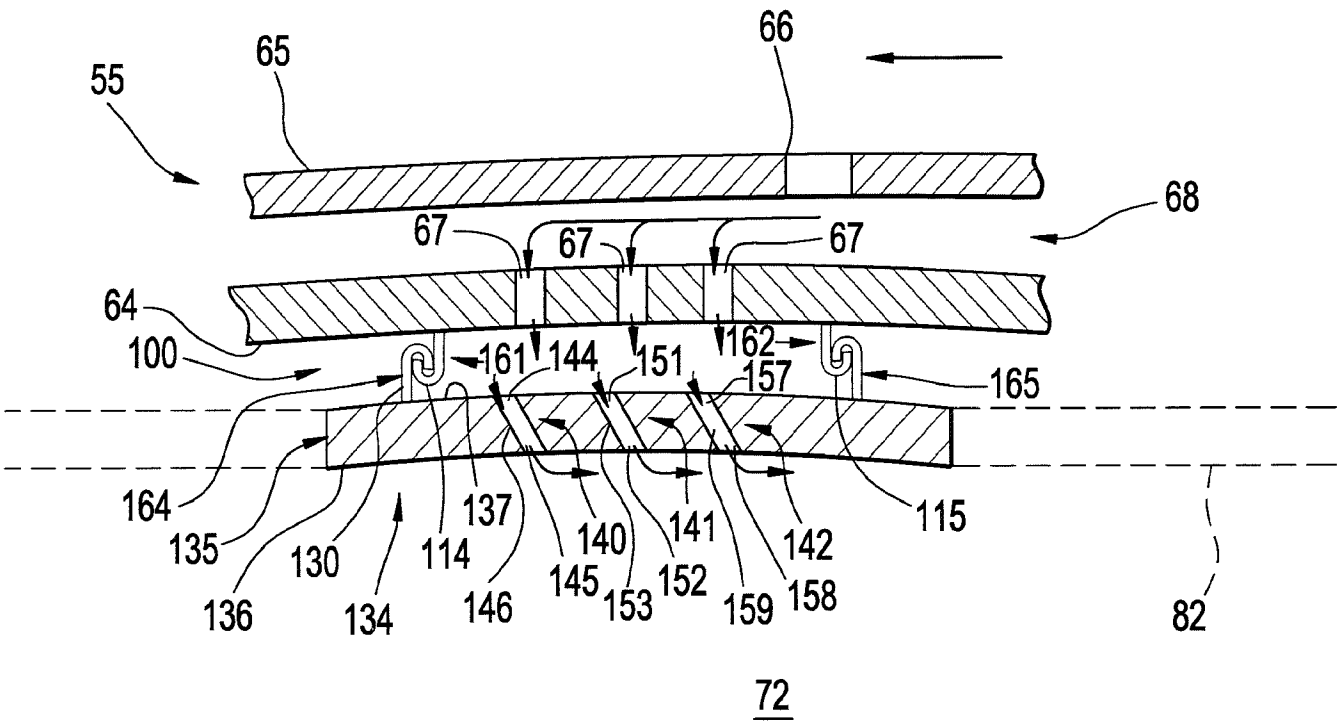
FIG. 4 is a detail view if a heat shield member in accordance with a second aspect of the exemplary embodiment.

Reference will now be made to FIG. 4, wherein like reference numerals represent corresponding parts in the separate views, in describing a heat shield member 134 constructed in accordance with another aspect of the exemplary embodiment. As shown, heat shield member 134 includes a body 135 having a first surface 136 and an opposing, second surface 137. Heat shield member 134 includes a plurality of dilution passages 140-142 that extend through body 135. In a manner similar to that described above, each dilution passage 140-142 is off-set from respective ones of dilution orifices 67 formed in inner wall 64 of transition piece 55. As will be discussed more fully below, each dilution passage 140-142 is configured to enhance cooling of heat shield member 134. More specifically, dilution passage 140 includes a first end section 144 that extends to a second end section 145 through an angled intermediate section 146. That is, first end section 144 is off-set from second end section 145 so as to increase an overall flow length of dilution passage 140. In this manner, that dilution air that forms an effusion flow passing through heat shield member 134 is provided with additional time to exchange heat, thereby enhancing thermal exchange. Similarly, dilution passage 141 includes a first end section 151 that extends to a second end section 152 through an angled intermediate section 153 and dilution passage 142 includes a first end section 157 that extends to a second end section 158 through an angled intermediate section 159. In a manner similar to that described above, each first end section 151 and 157 is off-set from corresponding ones of second end sections 152 and 158 so as to increase an overall flow length of dilution passages 141 and 142. In a manner also similar to that described above, heat shield member 134 includes first and second hook elements 164 and 165 that are configured to engage with hook members 108 and 109 on transition piece 55.

Figure 5:
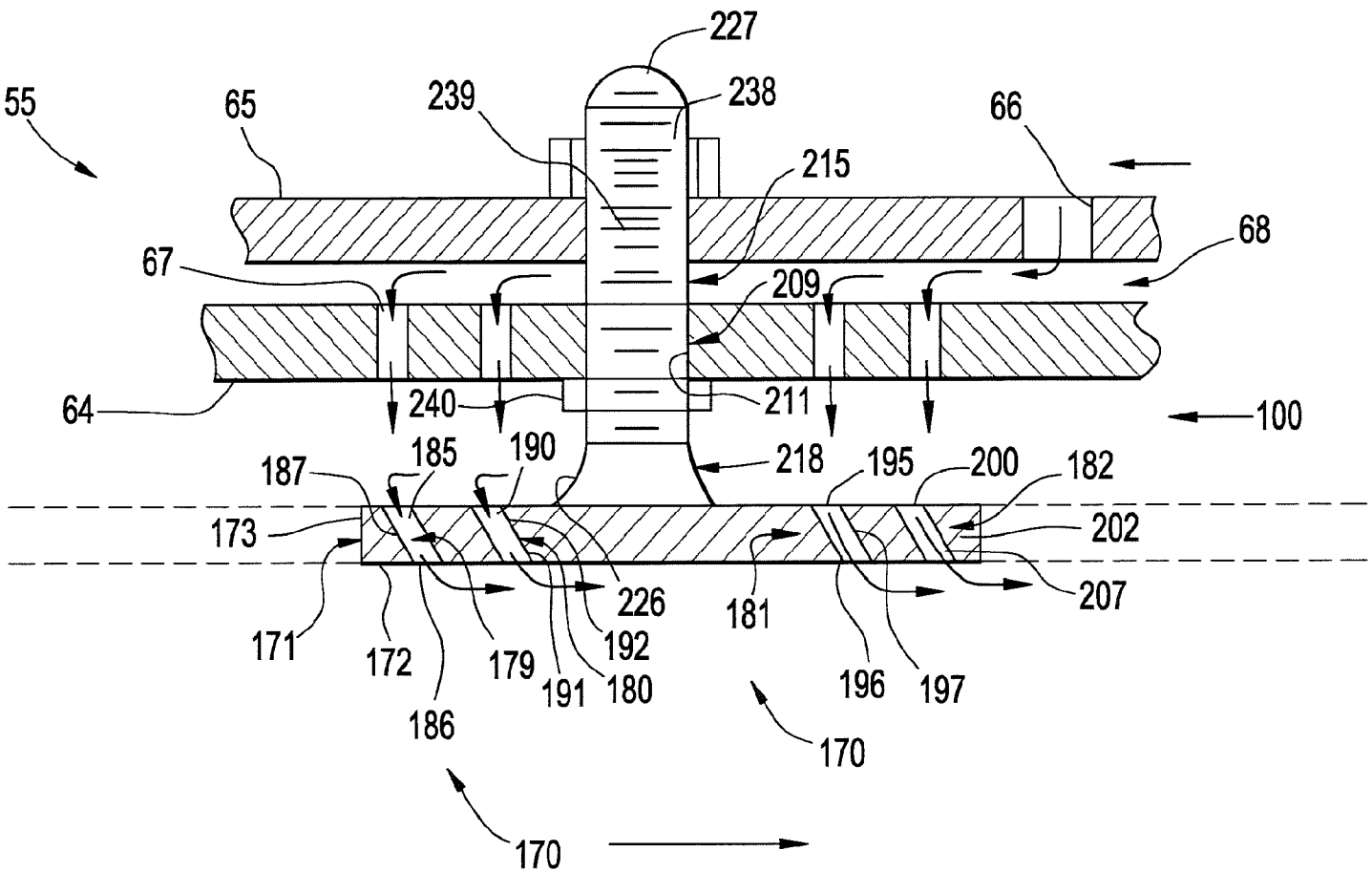
FIG. 5 is a detail view of a heat shield member in accordance with yet another aspect of the exemplary embodiment.

Reference will now be made to FIG. 5 in describing a heat shield member 170 constructed in accordance with yet another exemplary embodiment. As shown, heat shield member 170 includes a body 171 having a first surface 172 that extends toward an opposing, second surface 173. Heat shield member 170 includes a plurality of dilution passages 179-182 that extend between flow region 100 and combustor flow passage 72. In a manner also similar to that described above, each dilution passage 179-182 is configured to enhance heat transfer between cooling air passing through flow passage 100 towards combustor flow passage 72. That is, dilution passage 179 includes a first end section 185 that extends to a second end section 186 through an angled section 187. Likewise, dilution passage 180 includes a first end section 190 that extends to a second end section 191 through an angled section 192, dilution passage 181 includes a first end section 195 that extends to a second end section 196 through an angled section 197, and dilution passage 182 includes a first end section 200 that extends to a second end section 201 through and angled intermediate section 202. With this arrangement, each first end section 185, 190, 195 and 200 is off-set from corresponding ones of second end sections 186, 191, 196 and 201 so as to provide extended flow within body 171 to enhance heat transfer from heat shield member 170.

In further accordance with the exemplary embodiment shown, heat shield member 170 is mounted to, yet spaced from inner wall 64 of transition piece 55 so as to define flow passage 100. More specifically, inner wall 64 includes a mounting member 209 shown in the form of an opening 211. Outer wall 65 also includes an opening (not separately labeled) that is in alignment with opening 211. Heat shield member 170 includes a mounting element 215 shown in the form of a projection or stud 218 that extends from second surface 173. Stud 218 is configured to extend through opening 211 so as to secure heat shield member 170 to transition piece 55. More specifically, stud 218 includes a first end portion 226 that extends to a second end portion 227 and includes a threaded section 233 that is configured to receive a fastener 238. Fastener 238, shown in the form of a nut having a plurality of internal threads (not shown) configured to engage with threaded section 233, is secured to stud 218 thereby mounting heat shield member 170 to transition piece 55. A second fastener 240 can be employed to provide a desired spacing from inner wall 64 so as to ensure alignment between adjacent heat shield members and provide uniformity to flow passage 100.

At this point, it should be understood that the heat shield member is constructed in accordance with the exemplary embodiment to provide structure to reduce heat exposure to inner wall 64 of transition piece 55. As noted above, by decoupling inner wall 64 from the combustion gases in flow passage 72, cracking of inner wall 64, particularly in areas around dilution orifices 67 is mitigated. More specifically, hot gases ingested into a vena contracta formed with the dilution air mixes with the combustion gases leads to cracking of the inner wall 64 in areas adjacent dilution orifices 67. By providing an off set between dilution orifice 67 and dilution passage 96 ingestion of the hot gases is eliminated such that heat shield member 80 prolongs an overall operation life of transition piece 55. That is, by providing a sacrificial component within transition piece 55, the heat shield members enhance serviceability and maintenance while extending an overall service life of turbomachine 2.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

a combustor assembly including a combustor liner bounding a flow of combustion gases and having a plurality of injection nozzles arranged in a can-annular array;

a transition piece including at least one wall defining a combustion flow passage and bounding the flow of combustion gases;

at least one dilution orifice formed in the at least one wall of the transition piece, the at least one dilution orifice guiding dilution gases to the combustion flow passage;

a heat shield member mounted to the at least one wall of the transition piece in the combustion flow passage and positioned radially inside of the combustor liner such that a leading edge of the heat shield member is in contact with the flow of combustion gases, the heat shield member including a body having a first surface and an opposing second surface through which extends at least one dilution passage, the at least one dilution passage being off-set from the at least one dilution orifice, the heat shield member being spaced from the at least one wall of the transition piece so as to define a flow region between the at least one wall and the second surface, the flow region thermally decoupling the transition piece from combustion gases produced by the can-annular array of injection nozzles; and at least one mounting member provided on the transition piece; and at least one mounting element provided in the second surface of the heat shield member, the at least one mounting member being adapted to interact with the at least one mounting element to detachably mount the heat shield member to the transition piece.

2. The turbomachine according to claim 1, wherein, the at least one mounting member comprises a hook member extending outward from the at least one wall of the transition piece towards the combustion flow passage, and the at least one mounting element comprises a hook element extending substantially perpendicularly outward from the second surface of the heat shield member, the hook element being configured to couple with the at least one hook member to mount the heat shield member to the at least one wall of the transition piece.

3. The turbomachine according to claim 1, wherein the at least one mounting member comprises an opening that extends through the at least one wall of the transition piece and the at least one mounting element comprises a projection having a first end portion that extends from the second surface towards a second end portion, the second end portion being adapted to extend through the opening to mount the heat shield member to the transition piece.

4. The turbomachine according to claim 3, further comprising: a fastening element provided on the second end portion of the projection.

5. The turbomachine according to claim 4, wherein the second end portion of the projection includes a threaded section.

6. The turbomachine according to claim 4, wherein the fastening element comprises a nut having a plurality of internal threads that are configured to engage with the threaded section of the projection.

7. The turbomachine according to claim 1, wherein the dilution passage includes a first end section that extends to a second end section, the first end section being off-set from the second end section.

8. The turbomachine according to claim 1, wherein the at least one dilution orifice includes a plurality of dilution orifices and the at least one dilution passage includes a plurality of dilution passages, each of the plurality of dilution passages being off-set from each of the plurality of dilution orifices.

9. The turbomachine according to claim 1, wherein the second surface of the heat shield member includes a plurality of protuberances, the plurality of protuberances conditioning an airflow passing through the flow region.

10. A method of thermally decoupling a transition piece from combustion gases in a turbomachine, the method comprising:

creating cooling gases in a compressor portion of the turbomachine;

generating combustion gases in a plurality of combustion chambers arranged in a can-annular array, each of the plurality of combustion chambers including a combustor liner bounding the flow of combustion gases;

guiding the combustion gases into the transition piece of the turbomachine, the transition piece bounding the flow of combustion gases and fluidly connecting the can-annular array of combustion chambers with a first stage of a turbine;

shielding an internal surface of the transition piece from the combustion gases with at least one heat shield member, the at least one heat shield member being detachably mounted to and spaced from the internal surface of the transition piece to form a flow cavity, the heat shield positioned radially inside of the combustor liner such that a leading edge of the heat shield member is in contact with the flow of combustion gases;

passing the cooling airflow through at least one dilution orifice formed in the transition piece, the dilution orifice being fluidly connected to the flow cavity; and guiding the cooling airflow through at least one dilution passage formed in the at least one heat shield member, the at least one dilution passage being off-set from the at least one dilution orifice so as create an effusion airflow that passes over a surface of the at least one heat shield member to thermally decouple the inner wall of the transition piece from the combustion gases.

11. The method of claim 10, wherein guiding the cooling airflow through the at least one dilution passage comprises passing the cooling airflow into a first end section formed in a first surface of the heat shield member to a second end section, the second end section being off-set from the first end section.

12. The method of claim 10, further comprising: guiding the cooling airflow across a plurality of protuberances formed on the heat shield member.

13. The method of claim 10, wherein, passing the cooling airflow through at least one dilution orifice formed in the transition piece comprises passing the cooling airflow though a plurality of dilution orifices formed in the transition piece.

14. The method of claim 13, wherein, guiding the cooling airflow through at least one dilution passage formed in the at least one heat shield member comprises passing the cooling airflow through a plurality of dilution passages formed in the heat shield member, each of the plurality of dilution passages being off-set from respective ones of the plurality of dilution orifices.

* * * * *